US008171903B2

(12) United States Patent
Kim

(10) Patent No.: US 8,171,903 B2
(45) Date of Patent: May 8, 2012

(54) INTERMEDIATE LOCK PIN TYPE VARIABLE VALVE TIMING UNIT FOR VEHICLE AND CONTINUOUSLY VARIABLE VALVE TIMING DEVICE USING THE SAME

(75) Inventor: Woong Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 377 days.

(21) Appl. No.: 12/512,836

(22) Filed: Jul. 30, 2009

(65) Prior Publication Data

US 2010/0132642 A1 Jun. 3, 2010

(30) Foreign Application Priority Data

Dec. 3, 2008 (KR) ..... 10-2008-0121990
Dec. 4, 2008 (KR) ..... 10-2008-0122476

(51) Int. Cl.
*F01L 1/34* (2006.01)

(52) U.S. Cl. ..... 123/90.17

(58) Field of Classification Search ..... 123/90.12, 123/90.15, 90.17; 464/160, 161
See application file for complete search history.

(56) References Cited

U.S. PATENT DOCUMENTS

| | | | | |
|---|---|---|---|---|
| 6,076,492 | A * | 6/2000 | Takahashi | 123/90.17 |
| 6,378,475 | B2 * | 4/2002 | Takenaka et al. | 123/90.17 |
| 6,634,329 | B2 * | 10/2003 | Kusano et al. | 123/90.17 |
| 6,640,757 | B2 * | 11/2003 | Uchida | 123/90.12 |
| 6,739,298 | B2 * | 5/2004 | Kusano et al. | 123/90.17 |
| 6,883,478 | B2 | 4/2005 | Borraccia et al. | |
| 7,874,273 | B2 * | 1/2011 | Hertrich et al. | 123/90.17 |
| 2003/0101949 | A1 * | 6/2003 | Uchida | 123/90.12 |
| 2008/0035087 | A1 * | 2/2008 | Kim et al. | 123/90.17 |
| 2010/0101516 | A1 * | 4/2010 | Hertrich | 123/90.17 |

FOREIGN PATENT DOCUMENTS

| | | | |
|---|---|---|---|
| JP | 11-241608 | A | 9/1999 |
| JP | 2000-110534 | A | 4/2000 |
| JP | 2002-30909 | A | 1/2002 |
| JP | 2003-166441 | A | 6/2003 |
| JP | 2007-138795 | A | 6/2007 |
| JP | 2007-327490 | A | 12/2007 |
| JP | 2008-106635 | A | 5/2008 |
| KR | 10-2004-0050307 | A | 6/2004 |
| KR | 10-2007-0118180 | A | 12/2007 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

An intermediate lock pin (ILP) ILP type variable valve timing unit may include an ILP type stator having at least one chamber formed therein, a rotor accommodated in the chamber to rotate relatively to the ILP type stator, and a lock maintaining portion provided in the chamber to maintain locking of the stator and the rotor when an engine stops working. The ILP type continuously variable valve timing device includes an ILP type variable valve timing unit, an ILP type oil control valve mounted on a cam cap engaged with a cylinder head to operate a lock maintaining portion of the variable valve timing unit, and an ILP type oil flow path branched from a main oil flow path of the cylinder head to guide the supply of oil to the variable valve timing unit through the cam cap and the ILP type oil control valve.

11 Claims, 9 Drawing Sheets

<Prior Art>

INTERMEDIATE LOCK PIN TYPE VARIABLE VALVE TIMING UNIT FOR VEHICLE AND CONTINUOUSLY VARIABLE VALVE TIMING DEVICE USING THE SAME

CROSS-REFERENCE TO RELATED APPLICATION

The present application claims priority to Korean Patent Application Nos. 10-2008-0121990 and 10-2008-0122476, filed on Dec. 3, 2008 and Dec. 4, 2008, the entire contents of which are incorporated herein for all purposes by this reference.

BACKGROUND OF THE INVENTION

1. Field of the Invention

The present invention relates to a continuously variable valve timing device for a vehicle, and more particularly, to an intermediate lock pin (ILP) type variable valve timing unit for a vehicle and a continuously variable valve timing device using the same, which can improve an intake pumping efficiency to improve the fuel economy.

2. Description of Prior Art

In general, a continuously variable valve timing device is a system that continuously changes the opening/closing time of a valve by changing the phase of a cam shaft in accordance with the engine revolution and load of a vehicle.

A conventional continuously variable valve timing device 101, as illustrated in FIG. 10, briefly includes a crank angle sensor sensing the rotation angle of a crank shaft, a cam angle sensor sensing the rotation angle of a cam shaft 104, a variable valve timing unit 150 connected to one side of the cam shaft 104 via a timing belt to advance or retard the cam shaft 104, and an engine control unit (ECU) controlling an oil control valve 108 to supply oil to an advance chamber 111*a* or a retard chamber 111*b* of the variable valve timing unit 150 based on signals from the crank angle sensor and the cam angle sensor.

The variable valve timing unit 150 is composed of a stator 110 connected to the crank shaft via the timing belt so as to receive a rotating force of the crank shaft, and a vane-shaped rotor 120 engaged in a body with the cam shaft 104 to rotate relatively to the stator 110.

In the stator 110, a chamber 111, which is divided into the advance chamber 111*a* and the retard chamber 111*b* by the rotor 120, is formed. If oil is supplied to the advance chamber 111*a* through the oil control valve 108, a phase difference occurs between the rotor 120 and the stator 110 to rotate the cam shaft 104, and thus the timing of the valve is changed.

Naturally, if oil flows into the retard chamber 111*b* through the oil control valve 108, a phase difference in an opposite direction to that of the above-described phase difference occurs between the rotor 120 and the stator 110 to loosen the timing of the valve.

A lock pin 131 is formed on the rotor 120 so that the rotor 120 is locked into the stator 110 when an engine stops working, and a pin locking part, into which the lock pin 131 is locked, is formed on the stator 110.

Recently, in order to prevent fuel economy from being lowered due to deterioration of the intake pumping efficiency of the variable valve timing device 101, developments for application of an intermediate lock pin (ILP) system to an intake-side variable valve timing unit have been made.

The ILP type variable valve timing device increases a retard region by 20° in comparison to a general variable valve timing device 101 by changing the time when the lock pin 131 is locked into the pin locking part, and thus the intake pumping efficiency is heightened to improve the fuel economy.

Here, in the case of adopting the ILP type oil control valve that supplies or intercepts oil to the chamber 111 in order to release or maintain the locking between the lock pin 131 and the pin locking part, there is a need for a structure for mounting the ILP type oil control valve thereon within a range where the layout of an engine room is not changed.

Also, in the conventional ILP type variable valve timing device, the lock pin 131 may not be properly locked into the pin locking part when the engine stops working.

Accordingly, if the engine is re-started in a state where the lock pin 131 is not properly locked into the pin locking part, the rotor 120 may bump against the stator 110 to be damaged with noise occurrence.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an intermediate lock pin (ILP) type continuously variable valve timing device for a vehicle, which can shorten development time through mounting of an ILP type oil control valve within the range where the layout of an engine room is not changed and to provide an intermediate lock pin (ILP) type continuously variable valve timing device for a vehicle, which can make a rotor completely locked into a stator when an engine stops, and thus prevent the rotor from bumping against the stator and being damaged with noise occurrence when the rotor is re-started.

In an aspect of the present invention, the intermediate lock pin (ILP) type variable valve timing unit may include an ILP type stator having at least one chamber formed therein, wherein the chamber is defined between partition walls formed in an inner circumference of a stator body; a rotor including a vane and accommodated in the chamber to rotate relatively between the partition walls of the stator; and a lock maintaining portion provided in the chamber and configured to selectively lock the rotator to the stator so as to maintain locking of the stator and the rotor when an engine stops working.

The lock maintaining portion may include a guide projection formed to the rotor and elastically projectable from the rotor; a guide groove formed on the stator to receive the guide projection there in and guide the guide projection; and a locking groove formed at a portion of the guide groove to selectively lock the guide projection therein when the engine stops working, wherein a circumferential thickness between the locking projection and a distal end portion of the vane is shorter than a circumferential distance between the locking groove and the partition wall of the stator to prevent the vane from bumping against the partition wall of the stator.

The locking groove may be formed at an end portion of the guide groove.

The guide groove may be formed in the stator as a depression having the same depth according to a turning radius of the rotor, wherein a curvature ratio of the guide groove is substantially the same as a curvature ratio of the turning radius of the rotor.

The guide groove may be formed in the stator as an inclined depression having a depth that becomes deeper toward the locking groove according to a turning radius of the rotor, wherein a curvature ratio of the guide groove is substantially the same as a curvature ratio of the turning radius of the rotor.

In another aspect of the present invention, the lock maintaining portion may include a guide projection formed to extend from the rotor, and provided with a locking hole formed on one side thereof; a guide groove formed on the stator to receive the guide projection therein and guide the guide projection; and a locking projection formed at an end portion of the guide groove to be selectively locked into the locking hole when the engine stops working, wherein a circumferential thickness between the locking projection and a distal end portion of the vane is shorter than a circumferential distance between the locking groove and the partition wall of the stator to prevent the vane from bumping against the partition wall of the stator.

Plural chambers may be provided, and the lock maintaining portion is provided in one of the plural chambers.

In further another aspect of the present invention, the intermediate lock pin (ILP) type continuously variable valve timing device may include an ILP type variable valve timing unit; an ILP type oil control valve mounted on a cam cap engaged with a cylinder head to operate the lock maintaining portion of the variable valve timing unit; and an ILP type oil flow path branched from a main oil flow path of the cylinder head to guide the supply of oil to the variable valve timing unit through the cam cap and the ILP type oil control valve.

The ILP type oil flow path may include a first oil flow path formed in the cam cap to be communicated with a mount part formed on an upper surface of the cam cap; and a second oil flow path formed in a cam shaft to be communicated with the first oil flow path and to guide oil to the variable valve timing unit The first oil flow path may include a first groove formed on a front part of the cam cap to be communicated with the mount part; and a second groove formed on a bottom part of the cam cap to connect the first groove to the second oil flow path, wherein the second groove is formed in front of an advance oil groove.

The ILP type variable valve timing unit may be applied to an intake side, and the ILP type oil flow path is formed to be branched from the main oil flow path of an exhaust-side variable valve timing unit.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
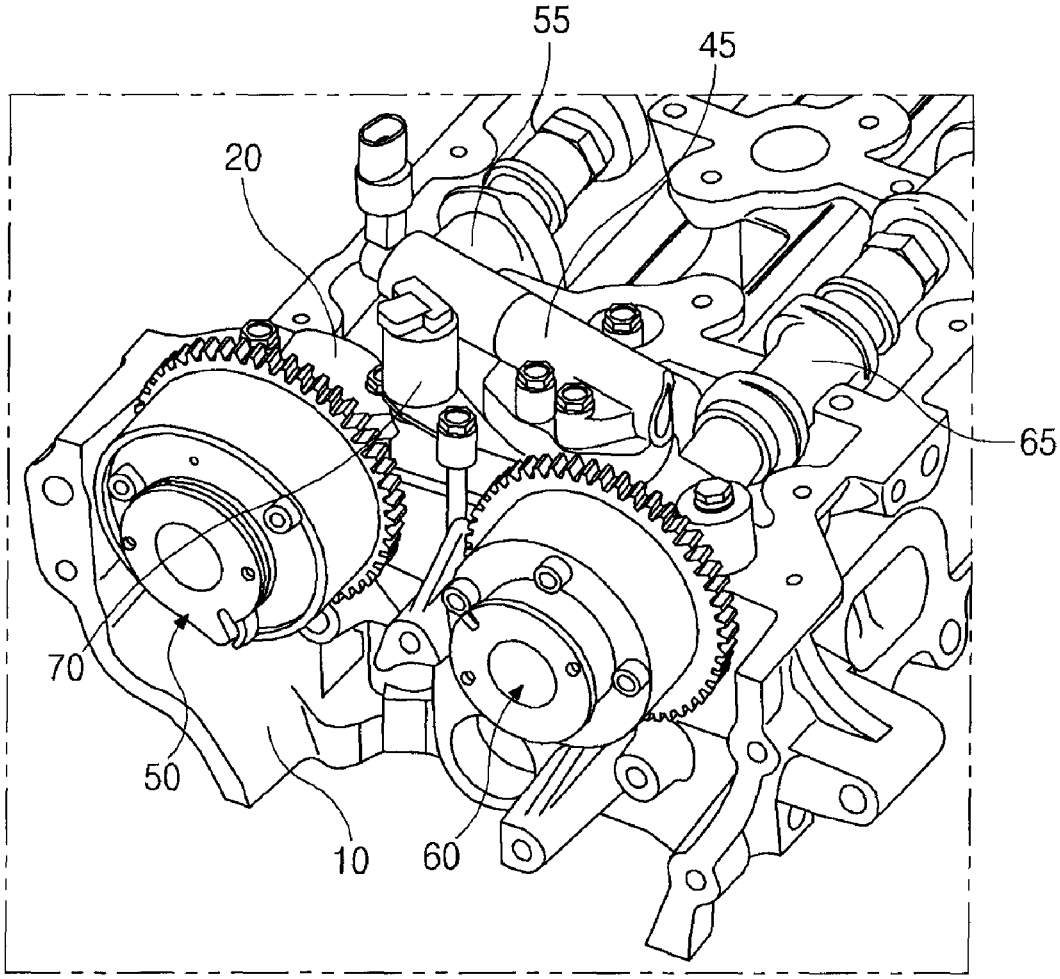
FIG. 1 is a perspective view illustrating an exemplary ILP type continuously variable valve timing device for a vehicle according to the present invention.
Figure 2:
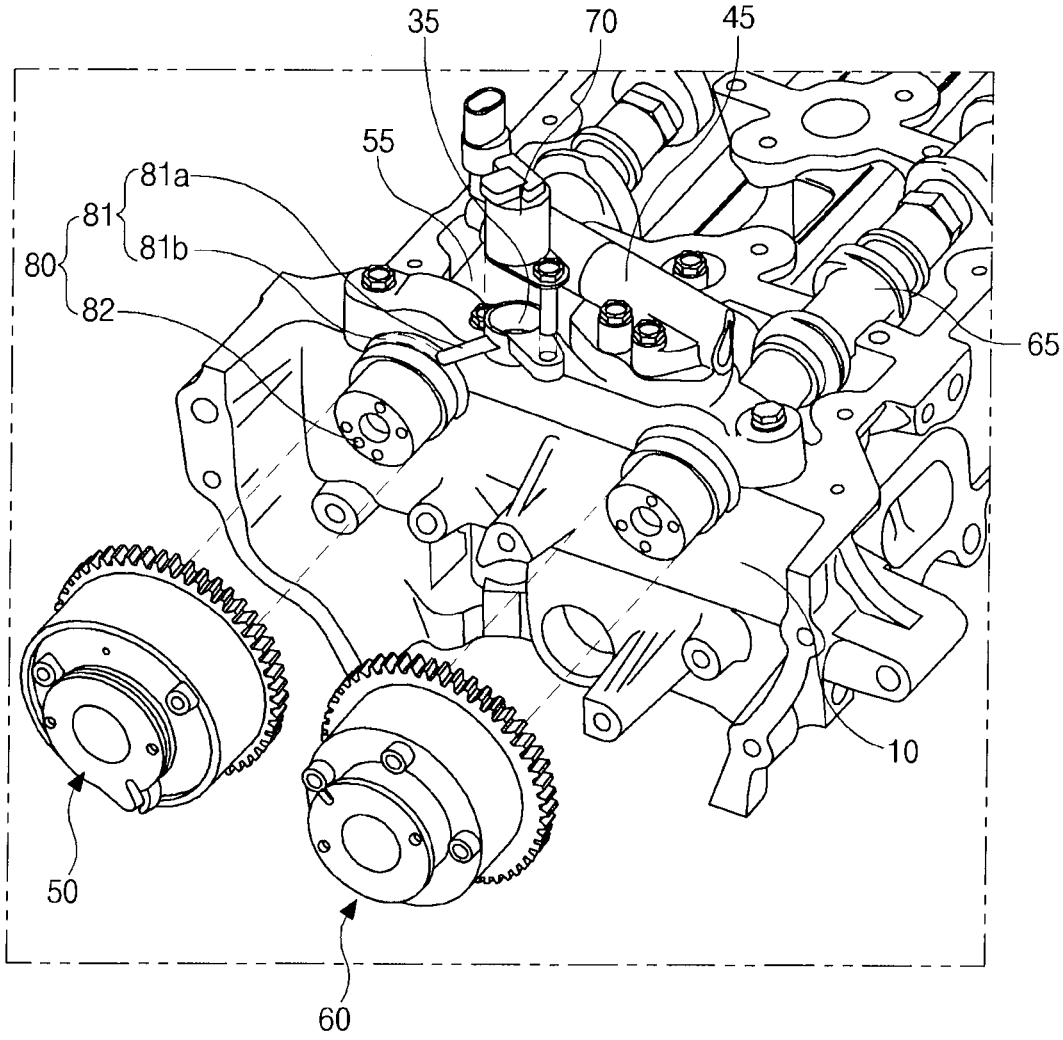
FIG. 2 is an exploded perspective view illustrating a state where the ILP type oil control valve of FIG. 1 is separated from a cam cap.

In various embodiments of the present invention, FIGS. 1 and 2 illustrate an ILP type continuously variable valve timing device for a vehicle according to various embodiments of the present invention.

The continuously variable valve timing device according to various embodiments of the present invention is of a dual type in which both an intake-side variable valve timing unit and an exhaust-side variable valve timing unit are provided, and the ILP type is applied to the intake-side variable valve timing unit 50.

The exhaust-side continuously variable valve timing device briefly includes a crank angle sensor sensing the rotation angle of a crank shaft, a cam angle sensor sensing the rotation angle of an exhaust-side cam shaft 65, an exhaust-side variable valve timing unit 60 connected to one side of the exhaust-side cam shaft 65 via a timing belt to advance or retard the exhaust-side cam shaft 65, and an engine control unit (ECU) controlling an exhaust-side oil control valve 45 to supply oil to an advance chamber or a retard chamber of the exhaust-side variable valve timing unit 60 based on signals from the crank angle sensor and the cam angle sensor.

Figure 3:
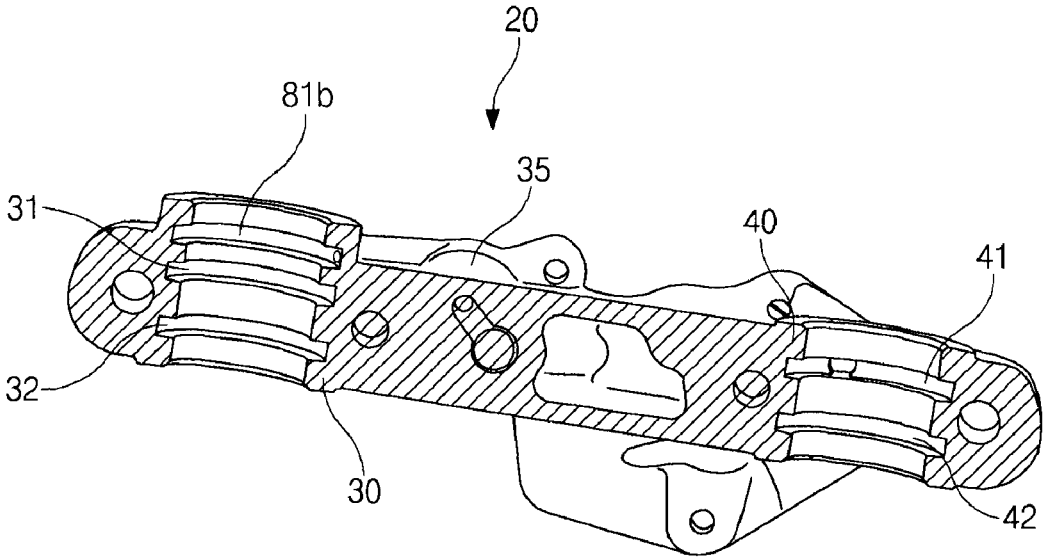
FIG. 3 is a perspective bottom view illustrating a cam cap of FIG. 1.

The exhaust-side oil control valve 45 is mounted on an upper surface of an exhaust-side cam cap 40 as illustrated in FIG. 3, and serves to selectively guide oil, which is supplied from an exhaust-side main oil flow path 85 (See FIG. 7) formed in a cylinder head 10, to the advance chamber or the retard chamber of the exhaust-side variable valve timing unit 60.

For this, on the bottom surface of the exhaust-side cam cap 40, as illustrated in FIG. 3, an advance oil groove 41 for guiding the oil, having passed through the exhaust-side oil control valve 45, to an advance oil hole 61 (See FIG. 7) to be described later, and a retard oil groove 42 for guiding the oil, having passed through the exhaust-side oil control valve 45, to a retard oil hole 62 (See FIG. 7) to be described later are formed as depressions.

Figure 7:
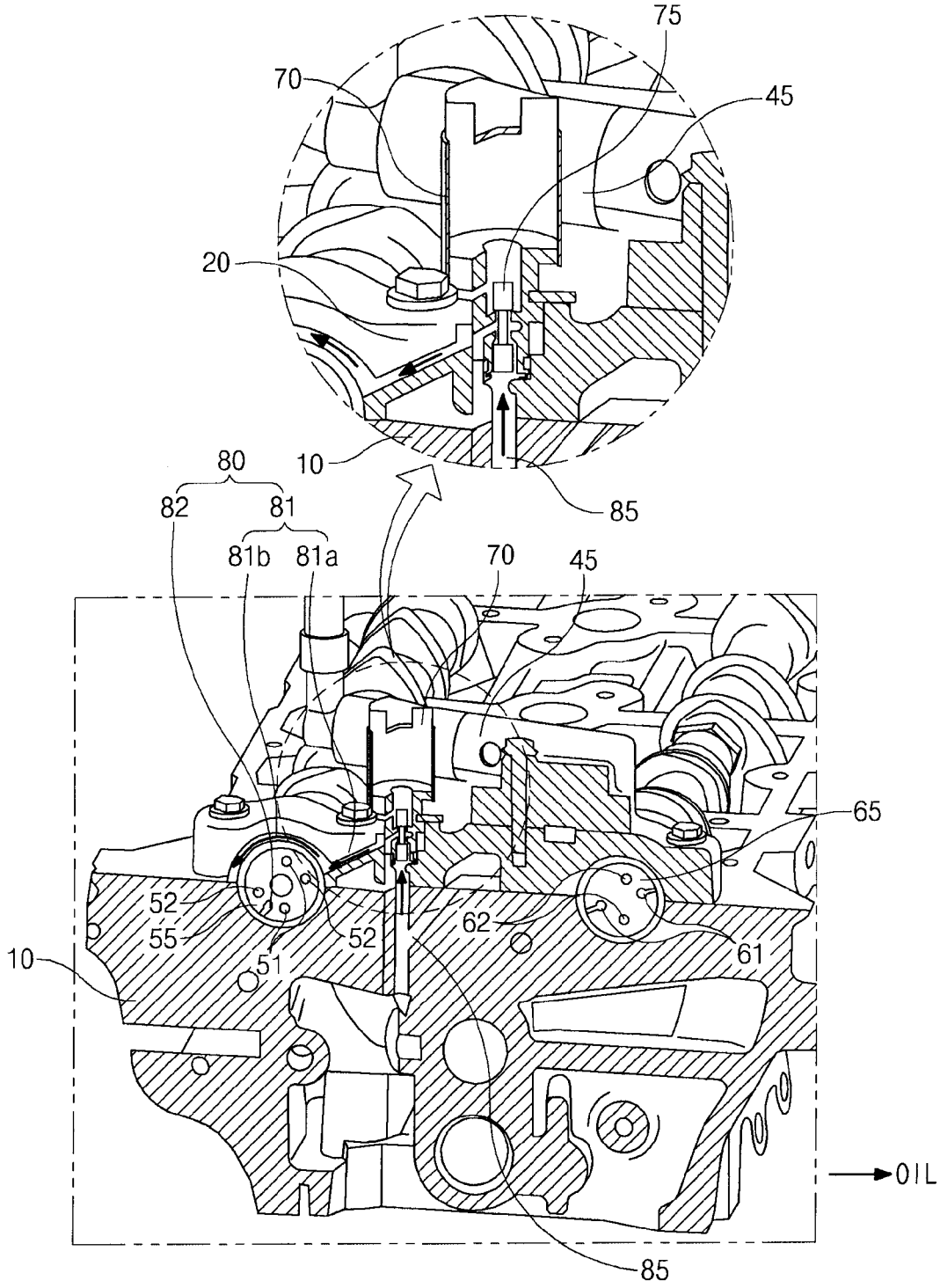
FIG. 7 is a perspective view illustrating a cross section of an ILP type oil flow path of FIG. 1.

Also, on the exhaust-side cam shaft 65, as illustrated in FIG. 7, the advance oil hole 61 for guiding the oil, being supplied from the exhaust-side main oil flow path 85 to the advance oil groove 41, to the advance chamber, and the retard oil hole 62 for guiding the oil, being supplied from the exhaust-side main oil flow path 85 to the retard oil groove 42, to the retard chamber are penetratingly formed.

Figure 6A:
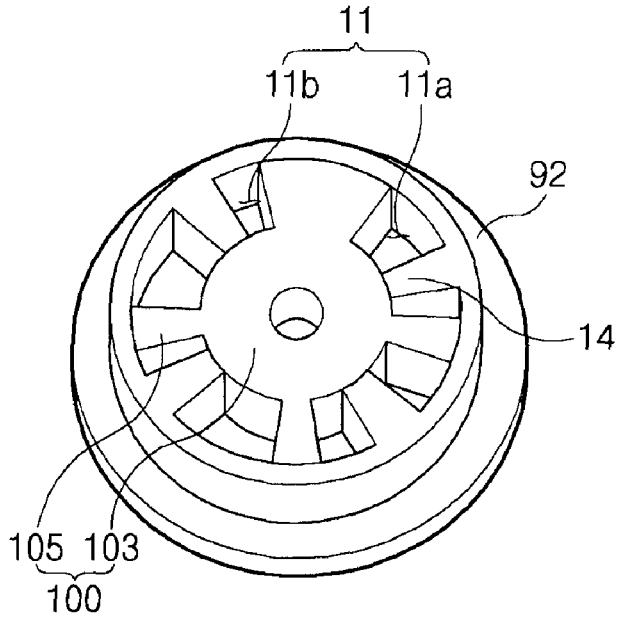
FIG. 6A is a perspective view illustrating a state where a rotor is accommodated in a stator body of FIG. 5.
Figure 6B:
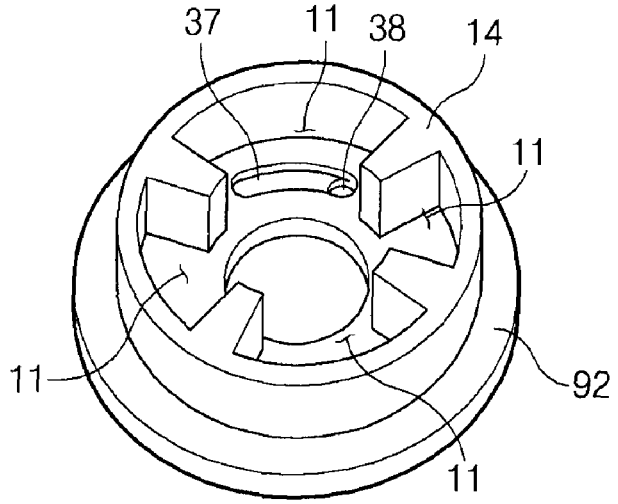
FIG. 6B is a perspective view illustrating a stator body of FIG. 6A.

On the other hand, the intake-side continuously variable valve timing device briefly includes a crank angle sensor sensing the rotation angle of a crank shaft, a cam angle sensor sensing the rotation angle of an intake-side cam shaft 55, an intake-side variable valve timing unit 50 connected to one side of the intake-side cam shaft 55 via a timing belt to advance or retard the intake-side cam shaft 55, and an ECU controlling an intake-side oil control valve to supply oil to an advance chamber 11*a* (See FIG. 6A) or a retard chamber 11*b* (See FIG. 6B) of the intake-side variable valve timing unit 50 based on signals from the crank angle sensor and the cam angle sensor.

In this case, the intake-side oil control valve, although not illustrated in the drawing, is mounted on one side of the cylinder head 10, and serves to selectively guide oil, which is supplied from an intake-side main oil flow path formed in the cylinder head 10, to the advance chamber 11*a* or the retard chamber 11*b* of the intake-side variable valve timing unit 50.

For this, on the bottom surface of an intake-side cam cap 30, as illustrated in FIG. 3, an advance oil groove 31 for guiding the oil, having passed through the intake-side oil control valve, to an advance oil hole 51 (See FIG. 4) to be described later, and a retard oil groove 32 for guiding the oil, having passed through the intake-side oil control valve, to a retard oil hole 52 (See FIG. 4) to be described later are formed as depressions.

Here, the intake-side cam cap 30 is formed in a body with the exhaust-side cam cap 40 to constitute a cam cap 20, and the cam cap 20 is assembled on the upper surface of the cylinder head 10 to rotatably support the exhaust-side cam shaft 55 and the intake-side cam shaft 65.

Figure 4:
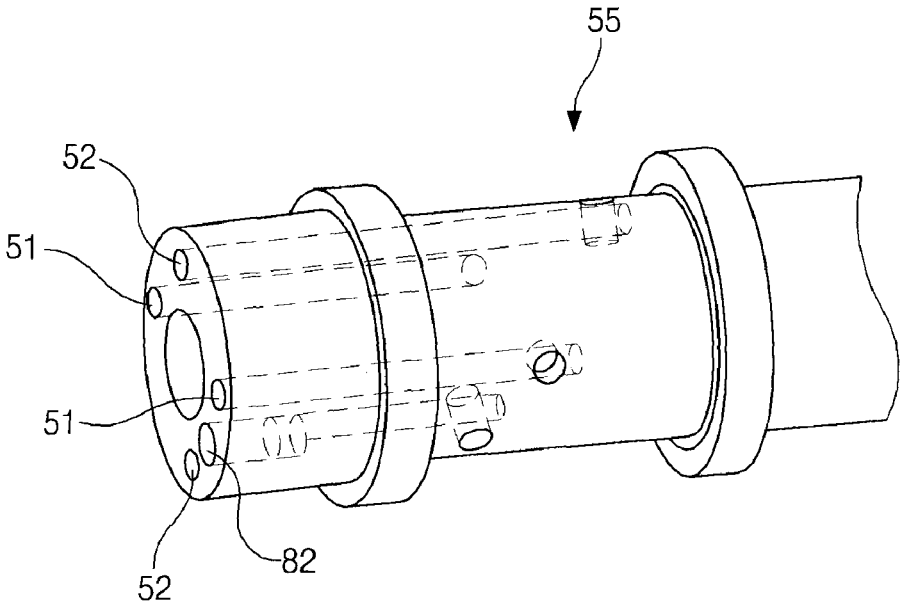
FIG. 4 is a perspective view illustrating an intake-side cam shaft of FIG. 1.

On the intake-side cam shaft 55, as illustrated in FIG. 4, the advance oil hole 51 for guiding the oil, being supplied from the intake-side main oil flow path to the advance oil groove 31, to the advance chamber 11*a*, and the retard oil hole 52 for guiding the oil, being supplied from the intake-side main oil flow path to the retard oil groove 32, to the retard chamber 11*b* are penetratingly formed. Also, on the intake-side cam shaft 55, a second oil flow path 82 constituting an ILP type oil flow path 80 to be described later is formed.

The intake-side variable valve timing unit 50 adopts the ILP type in order to prevent fuel economy from being lowered due to deterioration of its intake pumping efficiency. The ILP type intake-side variable valve timing unit increases a retard region by 20° in comparison to a general variable valve timing device by changing the time when a guide projection 16 is locked into a locking groove 38 as illustrated in FIGS. 5 and 6, and thus the intake pumping efficiency is heightened to improve the fuel economy.

Figure 5:
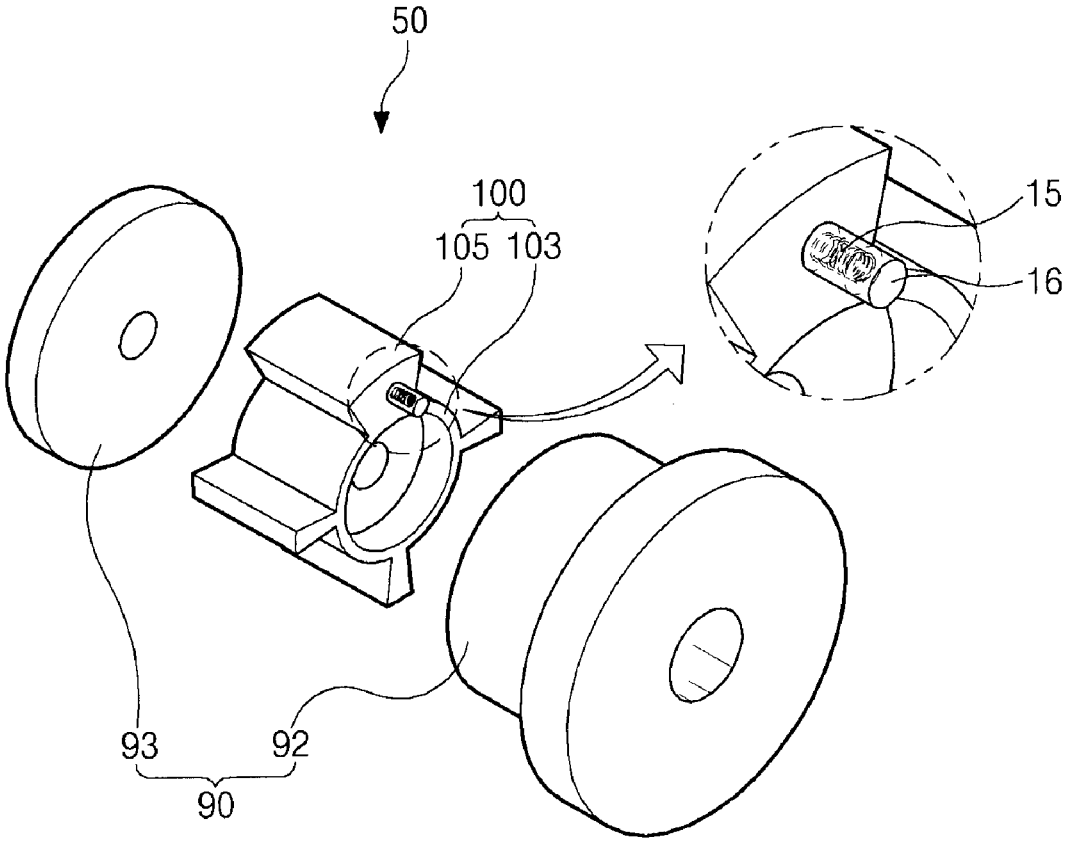
FIG. 5 is an exploded perspective view illustrating an intake-side variable valve timing unit of FIG. 1.

The intake-side variable valve timing unit 50, as illustrated in FIG. 5, includes an ILP type stator 90 connected to a crank shaft via a timing belt to receive a rotating force from the crank shaft, a rotor 100 engaged in a body with the intake-side cam shaft 55 to rotate relatively to the stator 90, and a lock maintaining portion provided in the stator 90 and the rotor 100 to maintain the locking of the rotor 100 into the stator 90 through guiding of the rotor 100 in the stator 90 when an engine stops working.

In the stator 90, as illustrated in FIG. 6, at least one chamber 11, which is divided into the advance chamber 11*a* and the retard chamber 11*b* by the rotor 100, is formed. If oil is supplied to the advance chamber 11*a* through the intake-side oil control valve, a phase difference occurs between the rotor 100 and the stator 90 to rotate the intake-side cam shaft 55, and thus the timing of the valve is changed.

Naturally, if oil flows into the retard chamber 11*b* through the intake-side oil control valve, a phase difference in an opposite direction to that of the above-described phase difference occurs between the rotor 100 and the stator 90 to loosen the timing of the valve.

At this time, the intake-side oil control valve supplies the oil to the advance chamber 11*a* and the retard chamber 11*b* under the control of the ECU. The ECU advances or retards the intake-side cam shaft 55 against the rotation angle provided by the timing belt by controlling the intake-side oil control valve based on signals transmitted from the crank angle sensor and the cam angle sensor and by grasping and performing feedback of an actual cam angle state provided from the cam angle sensor.

The stator 90 receives the rotating force of the crank shaft via the timing belt, and includes a stator body 92 having plural chambers 11 each of which is composed of the advance chamber 11*a* and the retard chamber 11*b*, and a cover 93 covering the stator body 92 in a state where the rotor 100 is accommodated in the chamber 11.

In this case, the plural chambers 11 are partitioned by partition walls 14 projected in radial direction from an inner surface of the stator body 92, and the advance chamber 11*a* and the retard chamber 11*b* of each chamber 11 are divided by a vane 105 of the rotor 100 to be described later.

The rotor 100 is engaged in a body with the intake-side cam shaft 55, and rotates relatively to the stator 90. The rotor 100 is composed of a cam shaft engagement part 103 for engaging the intake-side cam shaft 55 with the rotor 100, and the vane 105 extended from the cam shaft engagement part 103 to an outside, and accommodated in each chamber 11.

The lock maintaining portion is to maintain the locking of the rotor 100 into the stator 90 when the engine stops working. Since the locking of the rotor 100 into the stator 90 is normally maintained, the rotor 100 is prevented from bumping against the stator 90 and being damaged with noise occurrence when the rotor is re-started.

The lock maintaining portion includes a guide projection 16 pressed outwardly by a spring 15 mounted on the vane 105 of the rotor 100, guide groove 37 formed on the stator 90 as a depression with the same depth to guide the guide projection 16, and a locking groove 38 formed at an end of the guide groove 37 as a depression with a depth deeper than that of the guide groove 37 to lock the guide projection 16 therein.

The guide projection 16 is pressed outwardly by the spring 15. When the guide projection 16 passes through the guide groove 37, it is pressed by the guide groove 37 as the spring 15 is in a compressed state. When the guide projection 16 reaches the end of the guide groove 37, it is locked into the locking groove 38 as the spring 15 is extended.

It is preferable that the guide projection 16 is formed on any one of plural vane 105. If the guide projection 16 is formed on two or more vanes 105, the size of the intake-side variable valve timing unit 50 is enlarged, and it is required to change the shape of the existing chain cover and head cover.

The guide groove 37 is formed in the stator body 92 as a depression corresponding to a turning radius of the rotor 100 to guide the rotation of the guide projection 16. In this case, since the locking groove 38 formed at the end of the guide groove 37 has a depth that is deeper than that of the guide groove 37, the guide projection 16 is primarily moved along the guide groove 37, and then is completely locked into the locking groove 38 as it reaches the locking groove 38. Accordingly, the rotor 100 and the stator 90 are in a normal locking state when the engine stops working, and thus the rotor 100 is prevented from bumping against the stator 90 and being damaged with noise occurrence when the rotor is re-started.

In order to release or maintain the locking between the guide projection 16 and the locking groove 38, hydraulic pressure is used. Accordingly, on the upper surface of the cam cap 20, an ILP type oil control valve 70 is mounted.

The ILP type oil control valve 70 serves to supply or intercept the oil pressure for operating the ILP that is applied to the intake-side variable valve timing unit 50. That is, the ILP type oil control valve 70 supplies the oil to the chamber 11 or intercepts the supply of the oil to the chamber 11 to release or maintain the locking between the guide projection 16 and the locking groove 38 by oil pressure applied between the stator body 92 and the rotator 100.

Here, ILP type oil control valve 70 moves a spool valve 75 (See FIG. 7) on the solenoid principle. However, the type of the oil control valve 70 is not limited thereto, but diverse valves in the known range may be used as the oil control valve 70.

The ILP type oil control valve 70 has a mount part 35 formed adjacent to the exhaust-side oil control valve 45 on the upper surface of the cam cap 20. In this case, the ILP type oil flow path 80 is branched from the main oil flow path 85 (See FIG. 7) of the cylinder head 10 to guide the supply of oil to the intake-side variable valve timing unit 50 through the cam cap 20 and the intake-side cam shaft 55.

More specifically, the ILP type oil flow path 80, as illustrated in FIG. 7, includes a first oil flow path 81 formed in the cam cap 20 to be communicated with the mount part 35, and a second oil flow path 82 formed in the intake-side cam shaft 55 to be communicated with the first oil flow path 81 and to guide oil to the intake-side variable valve timing unit 50.

The first oil flow path 81 includes a first groove 81*a* formed on a front part of the cam cap 20 to be communicated with the mount part 35, and a second groove 81*b* formed on a bottom part of the cam cap 20 to connect the first groove 81*a* to the second oil flow path 82.

The second groove 81*b* is formed in front of an advance oil groove 31 formed on the bottom surface of the intake-side cam cap 30, and the second oil flow path 82 connected thereto is also positioned in front of the advance oil hole 51. Accordingly, the flow path of oil that is supplied from the exhaust-side main oil path 85 to the intake-side cam shaft 55 through the cam cap 20 is shortened, and thus quick responsibility can be obtained.

As described above, by making the ILP type oil control valve 70 mounted on the cam cap 20, it is not required to change the fastening position of the cylinder head 10 and the head cover, and the layout of the engine room is not changed to shorten the development time of the device.

Figure 8A:
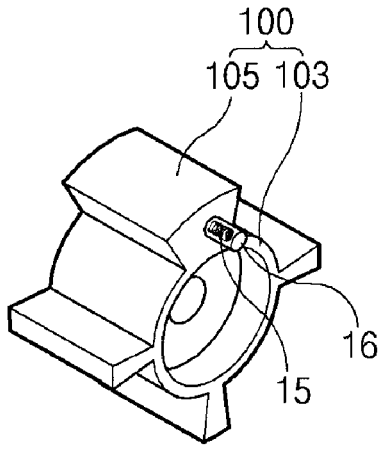
FIGS. 8A and 8B are perspective views illustrating an exemplary lock maintaining portion of an ILP type continuously variable valve timing device for a vehicle according to the present invention.
Figure 8B:
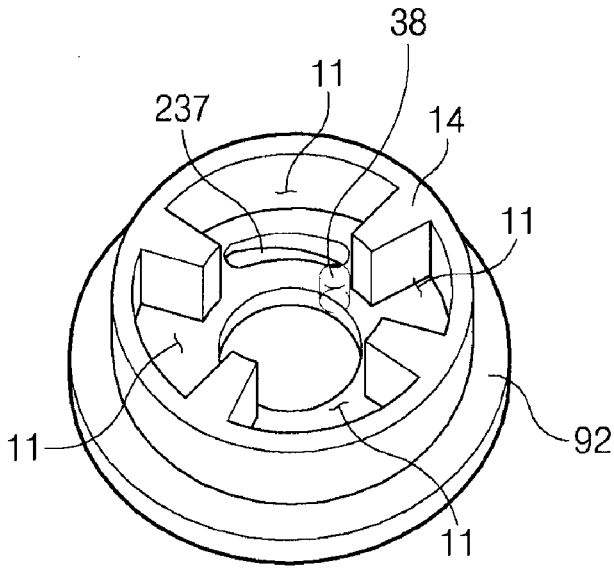

In other embodiments of the present invention, FIGS. 8A and 8B are perspective views illustrating a lock maintaining portion an ILP type continuously variable valve timing device for a vehicle according to other embodiments of the present invention.

In various embodiments, the lock maintaining portion includes a guide projection 16 elastically formed on the rotor 100, and a guide groove 237 formed in the stator body 92 as an inclined depression corresponding to a turning radius of the rotor 100.

The guide projection 16 is pressed outwardly by a spring 15 mounted on the rotor 100. In this case, since the guide projection 16 is initially pressed by the guide groove 237, the spring 15 is in a compressed state. Then, as the rotor 100 is rotated in a right direction, the depth of the guide groove 237 becomes deeper to extend the spring 15, and the guide projection 16 is completely projected outwardly at the end of the guide groove 237 to maintain the locking into the locking groove 38.

Figure 9A:
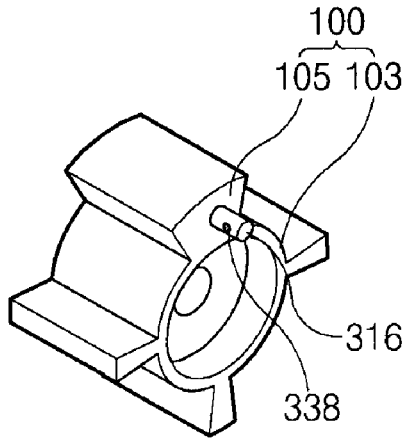
FIGS. 9A and 9B are perspective views illustrating a lock maintaining portion of an exemplary ILP type continuously variable valve timing device for a vehicle according to the present invention.
Figure 9B:
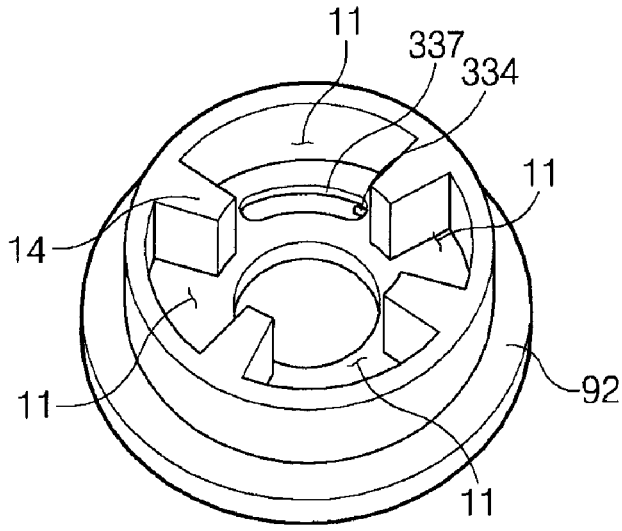
Figure 10:
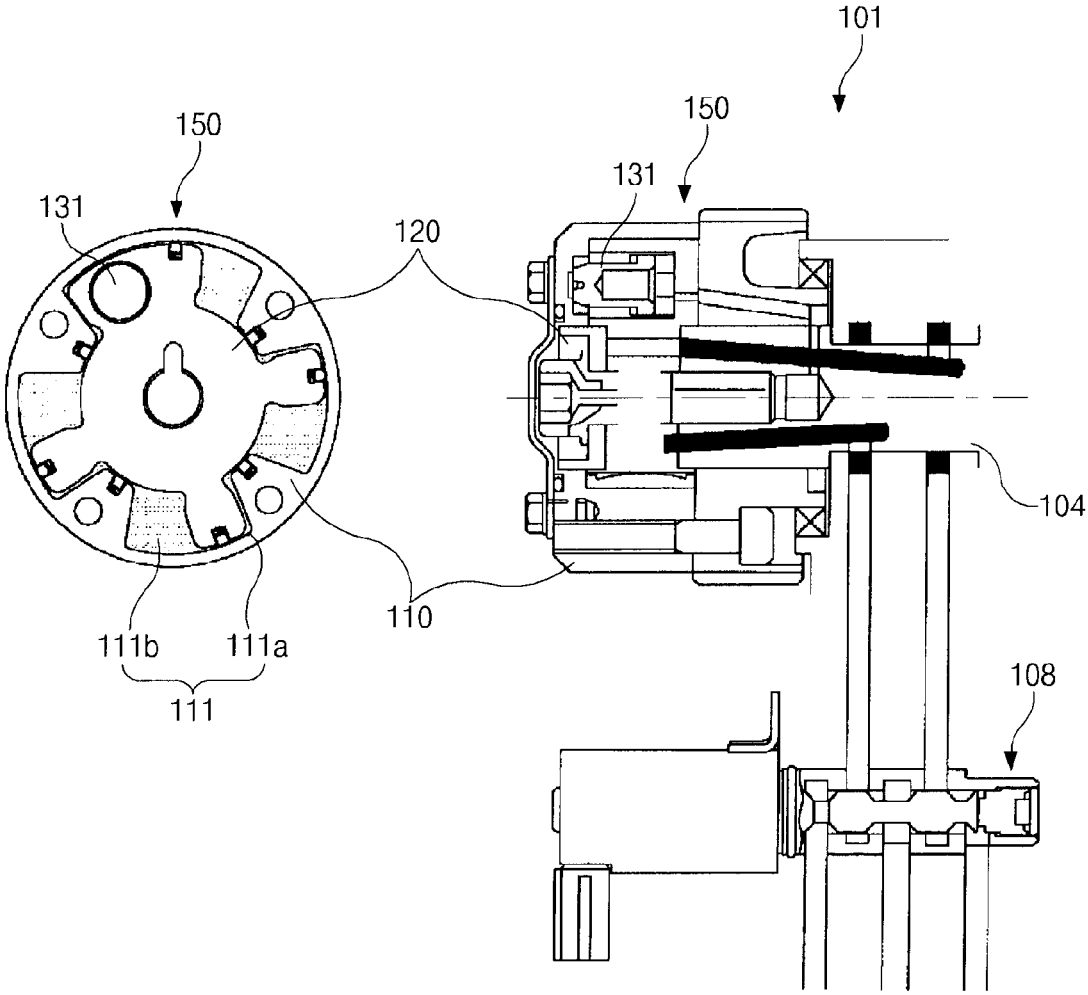
FIG. 10 is a sectional view schematically illustrating a conventional continuously variable valve timing device.

In further other embodiments of the present invention, FIGS. 9A and 9B are perspective views illustrating a lock maintaining portion of an ILP type continuously variable valve timing device for a vehicle according to various embodiments of the present invention.

As illustrated in FIGS. 9A and 9B, the lock maintaining portion includes a guide projection 316 formed to project from the vane 105 of the rotor 100 and provided with a locking hole 338 formed on one side thereof, and guide groove 337 formed on the stator body 92 as a depression having the same depth and corresponding to the turning radius of the rotor 100, and provided with a locking projection 334 formed at an end thereof to be locked into the locking groove.

As the rotor 100 is rotated in a right direction, the guide projection 316 is rotated along the guide groove 337, and when the locking projection 334 reaches the end of the guide groove 337, it is fitted into the locking hole 338 to maintain the locking. Accordingly, the rotor 100 is prevented from bumping against the stator 90 and being damaged with noise occurrence when the rotor is re-started.

As described above, according to various embodiments of the present invention, since the rotor 100 is normally locked into the locking position of the ILP type stator 90 when the engine stops working, the rotor 100 is prevented from bumping against the stator 90 and being damaged with noise occurrence when the rotor is re-started.

Also, since the ILP type oil control valve 70 for releasing or maintaining the locking of the rotor 100 into the ILP type stator 90 is mounted on the cam cap 20, it is not required to change the fastening position of the cylinder head and the head cover, and the layout of an engine room is not changed to shorten the development time.

In the above-described embodiments of the present invention, four vanes are provided in the rotor to correspond to the chambers. However, the number of chambers and vanes is not limited thereto, and one or more chambers and vanes may be used.

For convenience in explanation and accurate definition in the appended claims, the terms "bottom", "upper", and "inner" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An intermediate lock pin (ILP) type variable valve timing unit comprising:

an ILP type stator having at least one chamber formed therein, wherein the chamber is defined between partition walls formed in an inner circumference of a stator body;

a rotor including a vane and accommodated in the chamber to rotate relatively between the partition walls of the stator; and a locking maintaining portion provided in the chamber and configured to selectively lock the rotor to the stator so as to maintain locking of the stator and the rotor when an engine stops working;

wherein the lock maintaining portion comprises:

a guide projection formed to extend from the rotor, and provided with a locking hole formed on one side thereof;

a guide groove formed on the stator to receive the guide projection therein and guide the guide projection; and a locking projection formed at an end portion of the guide groove to be selectively locked into the locking hole when the engine stops working, wherein a circumferential thickness between the locking projection and a distal end portion of the vane is shorter than a circumferential distance between the locking groove and the partition wall of the stator to prevent the vane from bumping against the partition wall of the stator.

2. The ILP type variable valve timing unit of claim 1, wherein the lock maintaining portion comprises:

a guide projection formed to the rotor and elastically projectable from the rotor;

a guide groove formed on the stator to receive the guide projection there in and guide the guide projection; and a locking groove formed at a portion of the guide groove to selectively lock the guide projection therein when the engine stops working, wherein a circumferential thickness between a locking projection and a distal end portion of the vane is shorter than a circumferential distance between the locking groove and the partition wall of the stator to prevent the vane from bumping against the partition wall of the stator.

3. The ILP type variable valve timing unit of claim 2, wherein the locking groove is formed at an end portion of the guide groove.

4. The ILP type variable valve timing unit of claim 2, wherein the guide groove is formed in the stator as a depression having the same depth according to a turning radius of the rotor, wherein a curvature ratio of the guide groove is substantially the same as a curvature ratio of the turning radius of the rotor.

5. The ILP type variable valve timing unit of claim 2, wherein the guide groove is formed in the stator as an inclined depression having a depth that becomes deeper toward the locking groove according to a turning radius of the rotor, wherein a curvature ratio of the guide groove is substantially the same as a curvature ratio of the turning radius of the rotor.

6. The ILP type variable valve timing unit of claim 1, wherein plural chambers are provided, and the lock maintaining portion is provided in one of the plural chambers.

7. An intermediate lock pin (ILP) type continuously variable valve timing device comprising:

an ILP type variable valve timing unit recited in claim 1;

an ILP type oil control valve mounted on a cam cap engaged with a cylinder head to operate the lock maintaining portion of the variable valve timing unit; and an ILP type oil flow path branched from a main oil flow path of the cylinder head to guide the supply of oil to the variable valve timing unit through the cam cap and the ILP type oil control valve.

8. The ILP type continuously variable valve timing device of claim 7, wherein the ILP type oil flow path comprises:

a first oil flow path formed in the cam cap to be communicated with a mount part formed on an upper surface of the cam cap; and a second oil flow path formed in a cam shaft to be communicated with the first oil flow path and to guide oil to the variable valve timing unit.

9. The ILP type continuously variable valve timing device of claim 8, wherein the first oil flow path comprises:

a first groove formed on a front part of the cam cap to be communicated with the mount part; and a second groove formed on a bottom part of the cam cap to connect the first groove to the second oil flow path.

10. The ILP type continuously variable valve timing device of claim 9, wherein the second groove is formed in front of an advance oil groove.

11. The ILP type continuously variable valve timing device of claim 7, wherein the ILP type variable valve timing unit is applied to an intake side, and the ILP type oil flow path is formed to be branched from the main oil flow path of an exhaust-side variable valve timing unit.

* * * * *